United States Patent [19]

Bron

[11] 4,395,201

[45] Jul. 26, 1983

[54] INJECTOR PUMP

[76] Inventor: Dan Bron, 36 Palmach St., Haifa, Israel

[21] Appl. No.: 230,750

[22] Filed: Feb. 2, 1981

[30] Foreign Application Priority Data

Feb. 21, 1980 [IL] Israel ..... 59439

[51] Int. Cl.[3] ..... F04F 5/22

[52] U.S. Cl. ..... 417/169; 417/178; 417/186; 417/196

[58] Field of Search ..... 417/186–189, 417/151, 163, 165, 166, 169, 167, 168; 239/310, 318, 312, 317, 416.2, 416.3

[56] References Cited

U.S. PATENT DOCUMENTS

| | | | |
|---|---|---|---|
| 440,624 | 11/1890 | Eberman | 417/166 |
| 1,122,148 | 12/1914 | Gonzales | 417/166 |
| 3,282,227 | 11/1966 | Nielsen | 239/318 X |
| 3,338,173 | 8/1967 | Gunzel et al. | 417/186 X |

*Primary Examiner*—Edward K. Look
*Attorney, Agent, or Firm*—Murray Schaffer

[57] ABSTRACT

There is provided an in-line, two-stage, variable-bypass injector pump for controllably admixing a secondary fluid to a main fluid. The pump comprises a housing connectable into a pipe line carrying the main fluid and a main venturi extending along the central axis of the housing having an entrance and a throat and exit portion. The pump also includes a secondary venturi off center but substantially parallel to the central axis. The exit portion of the secondary venturi leads into the throat portion of the main venturi. One end of a connector leads into the throat portion of the secondary venturi and the other end of the connector is connectable to a source of the secondary fluid. An eccentrically located passage way permits a variable proportion of the main fluid to flow from one end of the housing to the other end thereof, while bypassing the main venturi. The bypassed flow is controlled by means of a shutter between a maximum and zero flow. By selectively creating a misalignment between two different portions of the passage way, a variable constriction is produced in the passage way, which constriction, when maximum, results in zero bypass flow and, when zero, results in maximum bypass flow.

13 Claims, 5 Drawing Figures

INJECTOR PUMP

The present invention relates to an in-line, two-stage, variable-bypass injector pump for controllably admixing a secondary fluid to a main fluid.

One of the advantages of modern irrigation systems such as drip irrigation is the possibility of controllable admixture, to the irrigation water, of liquid fertilizers or other chemicals. The central component of such an installation is the device by means of which the fertilizer solution is introduced into the irrigation main line. Arrangements used in the past for this purpose included complex combinations of pressurized vessels and valves rather expensive to maintain and not very reliable in operation. More recently, single-stage injector pumps were used to this end, which exploited the kinetic energy of the water in the main line to generate a suction effect that raised the liquid fertilizer from a fertilizer vessel and introduced it into the main line. While these devices were a definite improvement upon their predecessors, the pressure losses incurred were very large, varying between 1.5 and 2 atm. More elaborate versions of these prior-art injector pumps, using a two-stage approach, were more efficient to some degree, but still caused unreasonably high pressure losses, mainly due to repeated changes of flow direction within the device itself.

It is one of the objects of the present invention to overcome these drawbacks and to provide a simple, relatively inexpensive in-line injector pump which produces only very low pressure losses and is extremely reliable in operation.

This the invention achieves by providing an in-line, two-stage, variable-bypass injector pump for controllably admixing a secondary fluid to a main fluid, comprising:

a housing connectable into a pipe line carrying said main fluid;

a main venturi extending along the central axis of said housing and comprising an entrance, throat and exit portion;

a secondary venturi off center but substantially parallel to said central axis, comprising an entrance, throat and exit portion which exit portion leads into the throat portion of said main venturi;

a connector, one end of which leads into the throat portion of said secondary venturi and the other end of which is connectable to a source of said secondary fluid;

at least one eccentrically located passage way designed to permit a variable proportion of said main fluid to flow from one end of said housing to the other end thereof, while bypassing said main venturi, and shutter means to control said by-passing flow between a maximum and zero flow.

wherein, by selectively creating a misalignment between at least two different portions of said passage way, a variable constriction is produced in said passage way, which constriction, when maximum, results in zero bypass flow and, when zero, results in maximum bypass flow.

Experiments with the injector pump according to the invention, carried out under field conditions, have indicated pressure losses as low as 0.3 to 0.7 atm., depending on main-line pressure. The device was also shown to be most reliable in operation, in spite of a solids content of the fertilizer solution that has been known to have fouled other types of injector pumps. Being extremely simple and compact in design, the injector pump according to the invention can be almost entirely made of injection-molded plastics parts, which makes it not only incomparably cheaper than prior-art pumps, but also more corrosion-proof, less liable to scaling and, because of the small number of its parts, easier to dismantle and clean under field conditions.

While the invention will now be described in connection with certain preferred embodiments with reference to the following illustrative figures so that it may be more fully understood, it is stressed that the particulars shown and described are by way of example and for purposes of illustrative discussion only and are presented in the cause of providing what is believed to be the most useful and readily understood description of the principles and conceptual aspects of the invention. In this regard no attempt is made to show structural details of the apparatus and its constituents in more detail than is necessary for a fundamental understanding of the invention, the description taken with the drawings making apparent to those skilled in the art how the several forms of the invention may be embodied in practice.

Figure 1:
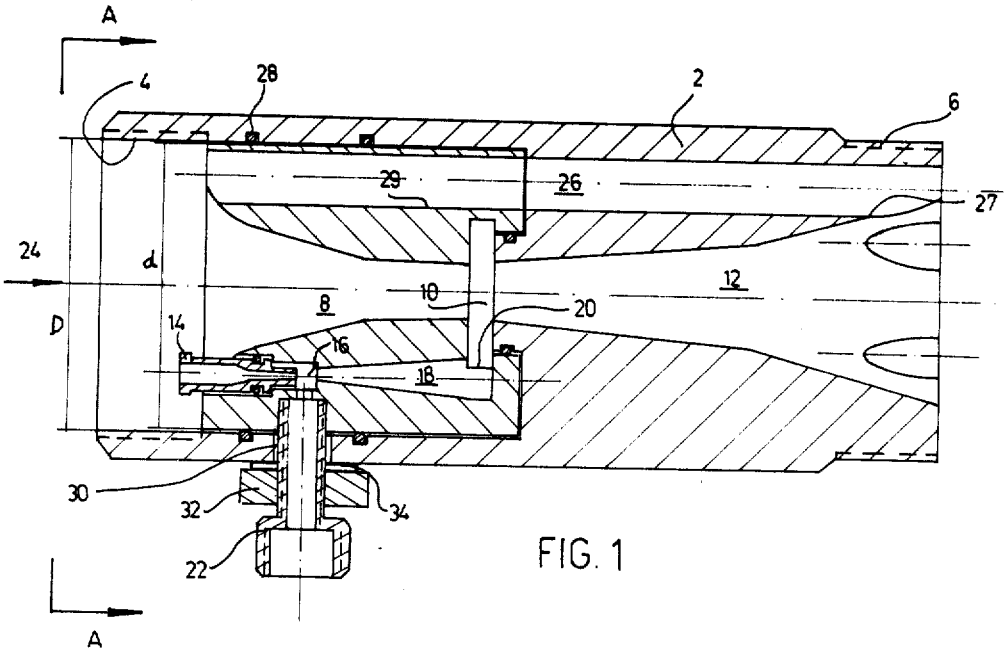
FIG. 1 shows a cross-sectional view of a preferred embodiment of the invention.

There is seen in FIG. 1 a housing 2 provided with two threaded ends 4 and 6 by means of which the device can be connected into a pipe line. Along the central axis of the housing 2 there extends a main venturi, comprising an entrance portion 8, a throat portion 10 and an exit portion 12 (It should be understood that, in the art, the term "throat portion" is applied to the narrowest section of the venturi and, according to the geometry of a particular venturi, might be of different axial extent, sometimes constituted by no more than the section where the entrance and exit portions meet.)

Off center with respect to the housing axis, but parallel to the main venturi, there is located a secondary venturi comprising an entrance portion 14, (either exchangeable as shown, or integral with the body of the main-venturi entrance portion 8), a throat portion 16 and an exit portion 18 which, via an annular recess 20, communicates with the throat portion 10 of the main venturi. Fixedly attached to the body of the entrance portion 8 of the main venturi and leading into the throat portion 16 of the secondary venturi there is a connector 22, to the free, outer end of which there is attachable a preferably flexible hose (not shown) which leads to a source of the liquid to be admixed to the irrigation water, for instance to a vessel containing this liquid.

In operation, water from the main line, flowing in direction of arrow 24, impacts the main venturi and produces at the throat portion 10 a low pressure which is also communicated to the exit portion 18 of the secondary venturi. The main-line water, however, also impacts the entrance portion 14 of the secondary venturi and, due to the already lower pressure at the exit portion 18, produces an even lower pressure at the throat portion 16, thereby drawing, via the connector 22, the secondary liquid, be it liquid fertilizer or any other liquid chemical, from its vessel connected to the connector 22 by a hose, as mentioned above. Arriving at the throat portion 16 of the secondary venturi, the secondary liquid is entrained by the main-liquid flow and fully admixed to the latter through the throat and exit portions 10 and 12 of the main venturi.

As so far described, the device would, however, provide only a single admixture ratio, mainly determined by the flow characteristics (rate, velocity) of the main liquid, and the geometries of the main and secondary venturies. Since, for practical purposes, these characteristics can be considered as fairly steady, other means must be provided to obtain different admixture ratios. This is done by permitting an adjustable proportion of the main liquid to bypass the main venturi, thereby not contributing to the creation of low pressure in the throat portion 10 of the main venturi, thus reducing the suction effect in the throat portion 16 of the secondary venturi and, thereby, the amount of secondary liquid drawn per unit volume of main liquid. In other words, a device providing a variable admixture ratio requires (a) a bypass for the main liquid; (b) this bypass must be variable.

In the preferred embodiment shown in FIG. 1 the bypass is realized in the form of a plurality of passage ways 26 (see also FIG. 2) of a circular cross section peripherally surrounding the main venturi. In the position shown in FIGS. 1 and 2, part of the main flow, instead of passing through the venturies, can flow from one end of the housing 2 straight to its other end by passing through these passage ways 26. However, to fulfill the above conditions for a variable admixture ratio, the bypass flow must be rendered variable between a maximum and zero flow.

This the invention achieves by the simple expedient of making at least one of the three main venturi components rotatable, whereby, as a result of such a rotational movement, a selective misalignment is created between at least two different portions 27 and 29 of the passage ways 26, thus producing a variable constriction acting as a shutter and reducing the effective cross sections of these passage ways 26. When these constrictions are at a maximum, the result is zero bypass flow; when zero, the result is maximum bypass flow.

In the embodiment of FIG. 1, this principle is realized by making the entrance portion 8 rotatable, which portion also includes the entire secondary venturi and at least part of the throat portion 10. The outside diameter d of the rotatable entrance portion 8 fits the machined inside diameter D of the housing 2 with clearance, O-rings 28 being provided to prevent undesirable leakages. Rotation of the entrance portion 8 is effected by swiveling the protruding part of the connector 22 in direction of arrow 21, to which end a peripheral slot 30 is provided in the housing 2, the axial position of which slot 30 determining the axial position of the rotatable entrance portion 8. The angular extent of this slot 30 determines the extremes (maximum bypass flow/zero bypass flow) of the angular displacement of the entrance portion 8. Once the desired angular position of the entrance portion 8, i.e., the desired admixture ratio, has been set, the connector 22 can be immobilized by means of a knurled locking ring 32 abutting against a suitably shaped pressure pad 34 which fills the space between the cylindrical surface of the housing 2 and the plane face of the locking ring 32.

Figure 2:
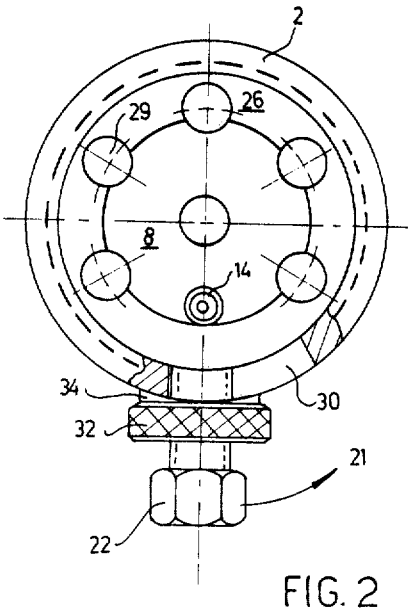
FIG. 2 is a side view of the injector pump of FIG. 1, as seen in direction of the arrows AA in FIG. 1.

FIG. 2 is a side view in direction of arrows A in FIG. 1, with a partial section, in a radial plane, through the center of the slot 30. As can be seen, the passageway portions 29 and 27 (hidden behind 29) are fully aligned and the entire cross sections of the passage ways 26 are free, for the bypass flow to pass through.

Figure 3:
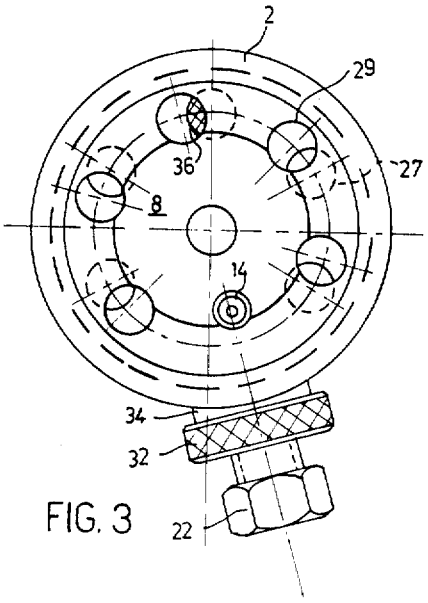
FIG. 3 is the same side view, with the rotatable entrance portion of the main venturi angularly offset, to produce a flow constriction.

FIG. 3, being a side view in the same direction as FIG. 2, shows the situation after some angular displacement of the entrance venturi 8 in direction of the arrow 21 in FIG. 2. It is seen that the passage-way portions 29 and 27 are no longer in alignment. The misalignment created by the slight swivel of the connector 22 has produced constrictions 36 (one of which is cross-hatched for clarity) which have the effect of reducing the bypass flow and, thus, increasing the amount of secondary liquid admixed to the unit volume of main liquid.

While the use of the entrance portion 8 of the main venturi as rotary shutter is advantageous, it is quite feasible to use the exit portion 12, or at least part of it, for the same purpose, and the same holds true also for the throat portion 10.

Figure 4:
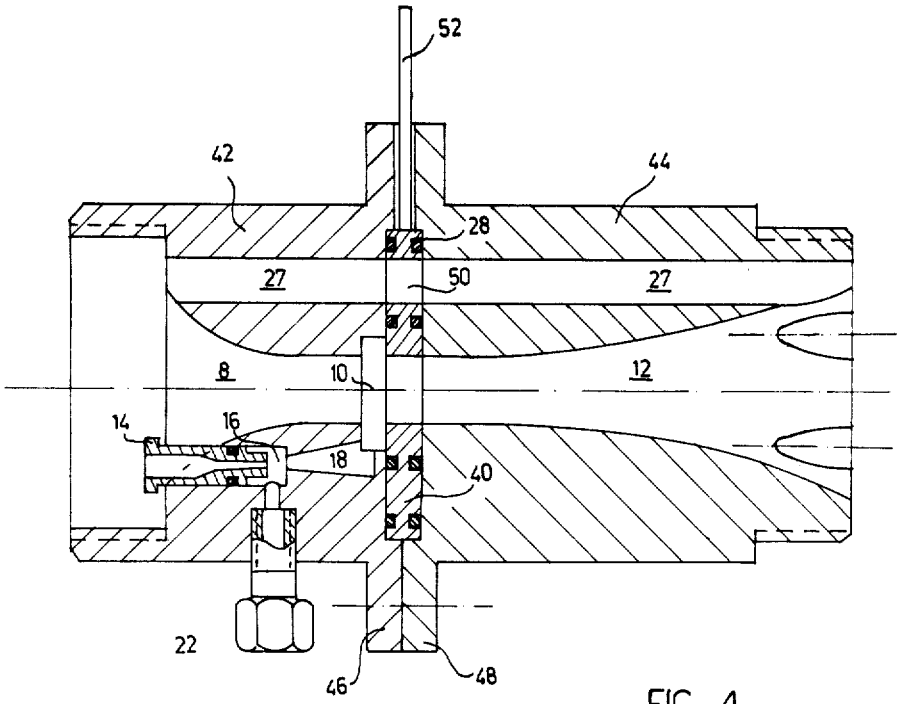
FIG. 4 shows a cross-sectional view of another embodiment of the invention, with disc-shaped shutter means.

FIG. 4 shows another embodiment of the injector pump according to the invention, in which a disc-shaped plate 40 mounted between the two parts 42 and 44 of a housing clamped together by means of flanges 46 and 48. The disc 40 is provided with a number of bores 50 peripherally spaced in similarity to the previously described arrangement. By moving a handle 52 protruding through angularly limited recesses in the flanges 46 and 48, these bores 50 can be brought into and out of alignment with the stationary bypass-flow passage ways 27, with the same bypass-flow-regulating effect. O-rings 28 ensure proper sealing, without interfering with the rotatability of the disc 40.

Figure 5:
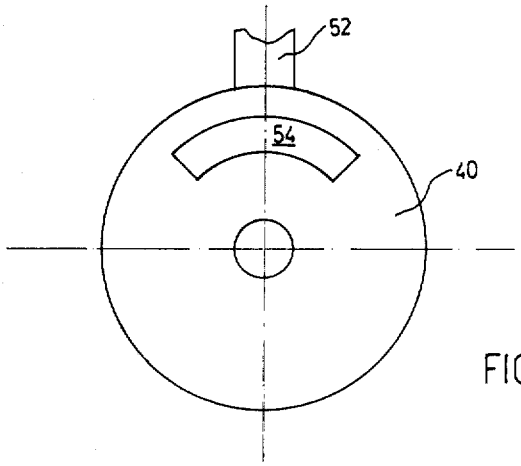
FIG. 5 shows a disc-type shutter with a bypass-flow opening in the shape of a segment of a circular ring.

While in the embodiments shown so far, the cross section of the bypass-flow passage ways was circular, this need not always be the case. FIG. 5 shows a shutter disc 40 in which the circular bores 50 have been replaced by a single opening 54 in the shape of a segment of a circular ring of an angular extent of about 90°. As the cross-sectional area of this opening is roughly equal to the sum of the cross-sectional areas of the circular bores 50 or 29 in the previous embodiments, a single opening only is required for the same throughput capacity. Obviously, the two stationary passage ways 27 are of the same shape and radial position as the opening 54. An advantage of this type of opening is the greater adjustment sensitivity, as the angular movement range from maximum to zero bypass flow is now about three times as large as in the previous embodiments. This type of passageway cross section can obviously also be applied to the embodiment of FIG. 1. The ends of the segment-like opening 54 can also be round.

For clarity, the O-ring grooves in the disc 40 in FIG. 5 have been left out.

As readily obvious to a man skilled in the art, another possible location for such a shutter disc would be the upstream end, or mouth, of the main-venturi entrance portion, in which position the central bore of the disc would have to be much larger and shaped to complement the entrance flare of the main venturi. Provision would also have to be made for a circular slot of sufficient angular extent to permit the disc to rotate without interfering with the entrance portion of the secondary venturi. Another slot would be required in the housing to accommodate, and limit the angular displacement of, the handle by means of which the disc is operated. Such an arrangement would have the advantage of obviating the need for a two-part housing as in the embodiment of FIG. 4.

While particular embodiments of the invention have been described, it will be evident to those skilled in the art that the present invention may be embodied in other specific forms without departing from the essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed is:

1. An in-line, two-stage, variable-bypass injector pump for controllably admixing a secondary fluid to a main fluid, comprising:

a housing connectable into a pipe line carrying said main fluid;

a main venturi extending along the central axis of said housing and comprising an entrance, throat and exit portion, a secondary venturi off center but substantially parallel to said central axis, comprising an entrance, throat and exit portion which exit portion leads into the throat portion of said main venturi;

a connector, one end of which leads into the throat portion of said secondary venturi and the other end of which is connectable to a source of said secondary fluid;

at least one passageway located off center with respect to said main venturi and designed to permit a variable proportion of said main fluid to flow from one end of said housing to the other end thereof, while bypassing said main venturi, and shutter means to control said bypassing flow between a maximum and zero flow, wherein, by selectively creating a misalignment between at least two different portions of said passage way, a variable constriction is produced in said passage way, which constriction, when maximum, results in zero bypass flow and, when zero, results in maximum bypass flow.

2. The injector pump as claimed in claim 1, wherein the cross section of said bypass-flow passage way is substantially circular.

3. The injector pump as claimed in claim 1, wherein the cross section of said bypass-flow passage way is substantially in the shape of a segment of a circular ring.

4. The injector pump as claimed in claim 1, wherein the entrance portion and at least a part of the throat portion of said main venturi are rotatable.

5. The injector pump as claimed in claim 1, wherein said shutter means are constituted by said rotatable entrance portion of said main venturi, which entrance portion also comprises said misalignable passage way.

6. The injector pump as claimed in claim 5, wherein the angular position of the rotatable entrance portion of said main venturi is settable with the aid of said connector, mechanical locking means being provided to immobilize said portion once set.

7. The injector pump as claimed in claim 1, wherein, to guide and delimit the setting motion of said connector, a peripheral slot is provided in said housing in the region of the entrance portion of said main venturi, and the angular extent of which slot determines the extremes of the angular displacement of said entrance portion.

8. The injector pump as claimed in claim 1, wherein said shutter means is constituted by the throat portion of said main venturi, which throat portion is designed to be rotatable.

9. The injector pump as claimed in claim 1, wherein said shutter means is constituted by at least a part of the exit portion of said main venturi, which part of the exit portion is designed to be rotable.

10. The injector pump as claimed in claim 1, wherein the entrance portion of said secondary venturi is exchangeable.

11. The injector pump as claimed in claim 1, wherein the entrance portion of said secondary venturi is integral with the body of the entrance portion of said main venturi.

12. An in-line, two-stage, variable-bypass injector pump for controlling admixing a secondary fluid to a main fluid, comprising:

a housing connectable into a pipe line carrying said main fluid;

a main venturi extending along the central axis of said housing and comprising an entrance, throat and exit portion, a secondary venturi off center but substantially parallel to said central axis, comprising an entrance, throat and exit portion which exit portion leads into the throat portion of said main venturi;

a connector, one end of which leads into the throat portion of said secondary venturi and the other end of which is connectable to a source of said secondary fluid;

at least one passageway located off center with respect to said main venturi and designed to permit a variable proportion of said main fluid to flow from one end of said housing to the other end thereof, while bypassing said main venturi, and shutter means to control said bypassing flow between a maximum and zero flow, wherein said shutter means are constituted by a rotatable disc-shaped plate located in the throat region of said main venturi, having a central bore appropriate to the diameter of the venturi at said region, and being provided with at least one opening located off center with respect to said main venturi and substantially identical and alignable with said bypass-flow passage way, wherein, by selectively creating a misalignment between at least two different portions of said passage way, a variable constriction is produced in said passage way, which constriction, when maximum, results in zero bypass flow and, when zero, results in maximum bypass flow.

13. The injector pump as claimed in claim 12, wherein the angular position of said disc-shaped plate is settable by means of a handle operatable from the outside of said housing.

* * * * *